US005812106A

United States Patent [19]

Hughes

[11] Patent Number: 5,812,106

[45] Date of Patent: Sep. 22, 1998

[54] ACTIVE MATRIX DISPLAY DEVICE

[75] Inventor: John R. Hughes, Horley, England

[73] Assignee: U.S. Philips Corporation, New York, N.Y.

[21] Appl. No.: 754,661

[22] Filed: Nov. 21, 1996

[30] Foreign Application Priority Data

Nov. 24, 1995 [GB] United Kingdom ..... 9524071

[51] Int. Cl.[6] ..... G09G 3/36

[52] U.S. Cl. ..... 345/90; 345/91

[58] Field of Search ..... 345/90–93, 98–100, 345/205, 212; 349/49, 50, 54

[56] References Cited

U.S. PATENT DOCUMENTS

| | | | |
|---|---|---|---|
| 5,159,325 | 10/1992 | Kuijk et al. | 345/84 |
| 5,428,370 | 6/1995 | Knapp et al. | 345/205 |
| 5,434,599 | 7/1995 | Hirai et al. | 345/100 |
| 5,459,483 | 10/1995 | Edwards | 345/98 |

FOREIGN PATENT DOCUMENTS 2129182 10/1984 United Kingdom .

*Primary Examiner*—Steven J. Saras
*Assistant Examiner*—Xu-Ming Wu
*Attorney, Agent, or Firm*—F. Brice Faller

[57] ABSTRACT

An active matrix display device, having an array of picture elements (12) comprising electro-optic, for example LC, display elements (14) and associated switching devices (15), for example thin film diodes, driven by selection and data signals applied to sets of row and column address conductors (16, 17) respectively, which includes a reference circuit (34) comprising a switching device (35) connected to a capacitive element (36) and similarly driven periodically by selection signals and a reference data signal applied via one of the column address conductors (17), and an adjustment circuit which senses the voltage at the capacitive element (36), indicative of the operational behavior of the switching device (35), at particular times corresponding substantially to the termination of a selection signal applied to the reference circuit and which, according to the sensed voltage at that time, is operable to adjust the drive voltages used for the picture elements (12) so as to compensate for changes in the operational behavior of the switching device.

9 Claims, 4 Drawing Sheets

ACTIVE MATRIX DISPLAY DEVICE

BACKGROUND OF THE INVENTION

This invention relates to a an active matrix display device comprising a set of row address conductors and a set of column address conductors, an array of picture elements each of which is connected to a respective address conductor of both sets and comprises an electro-optical display element connected to a switching device through which the display element is driven, drive means for applying driving signals to the sets of address conductors for driving the picture elements and comprising selection signals applied to one set of address conductors and data signals to the other set, a reference circuit to which the drive means is arranged to apply periodically selection signals corresponding to those applied to the one set of address conductors and a reference data signal which is applied via one of the address conductors of the other set, the reference circuit comprising a capacitive element and a switching device of the same kind as those of the picture elements connected such that the capacitive element is driven to a voltage according to the reference data signal on the one address conductor of the other set via the switching device upon the application of a selection signal to the reference circuit, and an adjustment circuit for sensing the voltage across the capacitive element of the reference circuit and adjusting the drive signals applied by the drive means to the picture elements in accordance with changes in the sensed voltage across the capacitive element.

An active matrix display device of the above kind is known from U.S. Pat. No. 5,428,370 in which there is described in a matrix display device wherein the electro-optic display elements comprise liquid crystal display elements and the switching devices comprise two-terminal non-linear switching devices in the form of thin film diodes such as MIMs. Through the reference circuit, compensation can be made for changes which occur over a period of time in the operating characteristics of the non-linear switching devices of the picture elements, in the form of drift, so as to maintain display performance. The reference circuit, comprising a non-linear switching device connected in series with a capacitor, provides an indication of drift in the I–V characteristic of the non-linear switching device of the reference circuit, which reflects the behaviour of the non-linear switching devices of the picture elements, and, together with the adjustment circuit, is operable in the manner of a feedback circuit to adjust the drive signals used to drive the picture elements so as to correct for the effects of such drift. More particularly, the voltage at the capacitor of the reference circuit, which is dependent on the operating characteristic of the non-linear device of the reference circuit and may vary over a period of time in accordance with a corresponding variation in the on-current of the switching device, is monitored and predetermined changes in this voltage are used to effect appropriate adjustments to the drive signals for the picture elements in order to compensate for such variation. The behaviour of the switching device of the reference circuit is taken to correspond to the behaviour of the switching devices of the picture elements, the series combination of the switching device and the capacitor of the reference circuit being equivalent to a picture element and being driven in a corresponding manner. Therefore, changes in display performance due to ageing effects in the switching devices of the picture elements affecting their I–V characteristics, and thus the voltages applied to their associated display elements which are determined by the on-current, can be largely eliminated. These voltage changes may either be in the peak to peak amplitude of the voltage or in the mean d.c. voltage depending on the particular drive scheme employed. As described in U.S. Pat. No. 5,428,370, it is particularly advantageous to use one, or more, picture elements located at the periphery of the display panel and outside the actual display area as a reference circuit(s) and to drive the reference circuit(s) via row and column address conductors on the substrate. The provision of the reference circuit is thereby greatly simplified and the behaviour of the reference circuit will be very close to that of the picture elements forming the display. The selection signals applied to one end of the reference circuit, using a dedicated row address conductor, can then be substantially identical to those used for the row address conductors associated with the picture elements and provided by the same row driver circuit. The reference data signal applied to the other end of the series combination is preselected and equivalent to, for example, a mid-level data signal supplied from a column driver circuit via the column address conductors to the picture elements. In the arrangements described, the voltage across the capacitor, through which changes in the behaviour of the non-linear device are detected, is continuously monitored and the mean amplitude of the time averaged value of this voltage, that is, a mean DC level, is compared in a comparator circuit with a reference voltage and the output from the comparator circuit is then used to control the voltage levels forming the selection signals.

OBJECTS AND SUMMARY OF THE INVENTION

It is an object of the present invention to provide an improved active matrix display device of the kind described above.

According to the present invention, there is provided an active matrix display device of the kind described in the opening paragraph which is characterised in that the adjustment circuit is arranged to derive a signal indicative of the voltage across the capacitive element sensed substantially upon the termination of the application of a selection signal to the reference circuit which indicative signal is used for determining adjustment to the drive signals until the reference circuit is addressed with a subsequent selection signal. Thus, any adjustments to the drive voltages signal levels used for driving the picture elements are determined according to the voltage across the capacitor sensed at particular times, corresponding to the addressing of the reference circuit with a selection signal, rather than continuously as in the case of the arrangement described in U.S. Pat. No. 5,428,370 in which that voltage is monitored and adjustment made to the drive voltages according to the sensed voltage on a continual basis. The invention stems from a recognition that problems can occur with the known arrangement which can reduce the effectiveness of the compensation obtained. Due to the fact that the reference data voltage signal for the reference circuit is applied via an address conductor of the other set, i.e. a column address conductor, which is used also to apply the data signals intended for the picture elements in the array associated with that address conductor, then part of the data signal waveform constituting those other data signals and supplied to the address conductor is capacitively coupled onto the output of the reference circuit supplied to the adjustment means. In certain circumstances, for example when a plain field is being displayed on the picture element array, then the mean level of the data signal waveform applied to the address conductor can have a DC offset, particularly when a so-called kickback compensation technique is employed where the data signal waveform for a column address conductor is adjusted prior to being applied to the column address conductors so as to compensate for the effects of kickback by changing the mean level of the waveform as a function of the drive level. An undesirable interaction can then occur where the adjustment circuit compensates for such a DC offset which is not due to a change in the non-linear device characteristics. In using for the purpose of drive voltage adjustment a signal indicative of the voltage across the capacitor at a certain time only according to the invention, instead of continually, then problems of this kind are avoided and more reliable and accurate compensation is achieved. The value of this voltage is not utilised in the drive signal adjustment feedback operation during periods when it can be affected by such factors as a DC offset in the data signal waveform applied to the address conductor used by the reference circuit.

Preferably, the signal indicative of the voltage across the capacitive element is derived immediately after the termination of the selection signal and before the termination of the reference data signal. The signal cannot then be effected by the appearance on the address inductor of a data signal for a picture element. Any problems which may be caused by, for example, a capacitive kickback effect in the reference circuit or a change in the signal level on the address conductor used for the reference data voltage signal, for example when a picture element data signal is applied to that conductor, is avoided. The signal could perhaps be derived instead towards the end of the selection signal period, again of course while the reference data signal is being applied, but as the voltage across the capacitive element may not have stabilised at that point, such sensing would not be as easy to perform.

The invention is intended particularly for display devices of the kind in which the switching devices comprise two terminal non-linear switching devices, such as this film diodes, for example as described in U.S. Pat. No. 5,428,370, in which each picture element comprises a display element connected in series with a switching device between respective row and column address conductors and in which the reference circuit comprises a series combination of a switching device and a capacitive element with the drive means arranged to apply the selection signals to one end of the series combination and the reference data signal to the other end. It is envisaged, however, that the invention could be applied to advantage in display devices using other kinds of switching devices.

The adjustment circuit preferably includes a sample and hold circuit from which the signal indicative of the voltage across the capacitive element is obtained and which is operable in accordance with the selection signals applied to the reference circuit so as to sample and hold a voltage signal representing the voltage across the capacitor.

In conventional display devices of the kind using two-terminal non-linear switching devices the polarity of successive selection signals used in the scanning waveform alternates. The sample and hold circuit is preferably then arranged to sample and hold the voltage signal upon positive and negative selection signals separately in the sample and hold circuit. The separately sampled values may be supplied to an arithmetic combining circuit whose output is used in the determination of any adjustment to the drive voltages. Alternatively, the separate polarity sampled voltage values may be used independently to adjust the values of the positive and negative selection signals of the scanning signal. Possibly, the signal derived in response to only one polarity of selection signal may be used for the purpose of effecting adjustment but this may give a reduced level of effectiveness.

BRIEF DESCRIPTION OF THE DRAWINGS

Embodiments of active matrix display devices according to the present invention will now be described, by way of example, with reference to the accompanying drawings, in which.

The same reference numbers are used throughout the Figures to indicate the same or similar parts.

DESCRIPTION OF THE PREFERRED EMBODIMENTS

Figure 1:
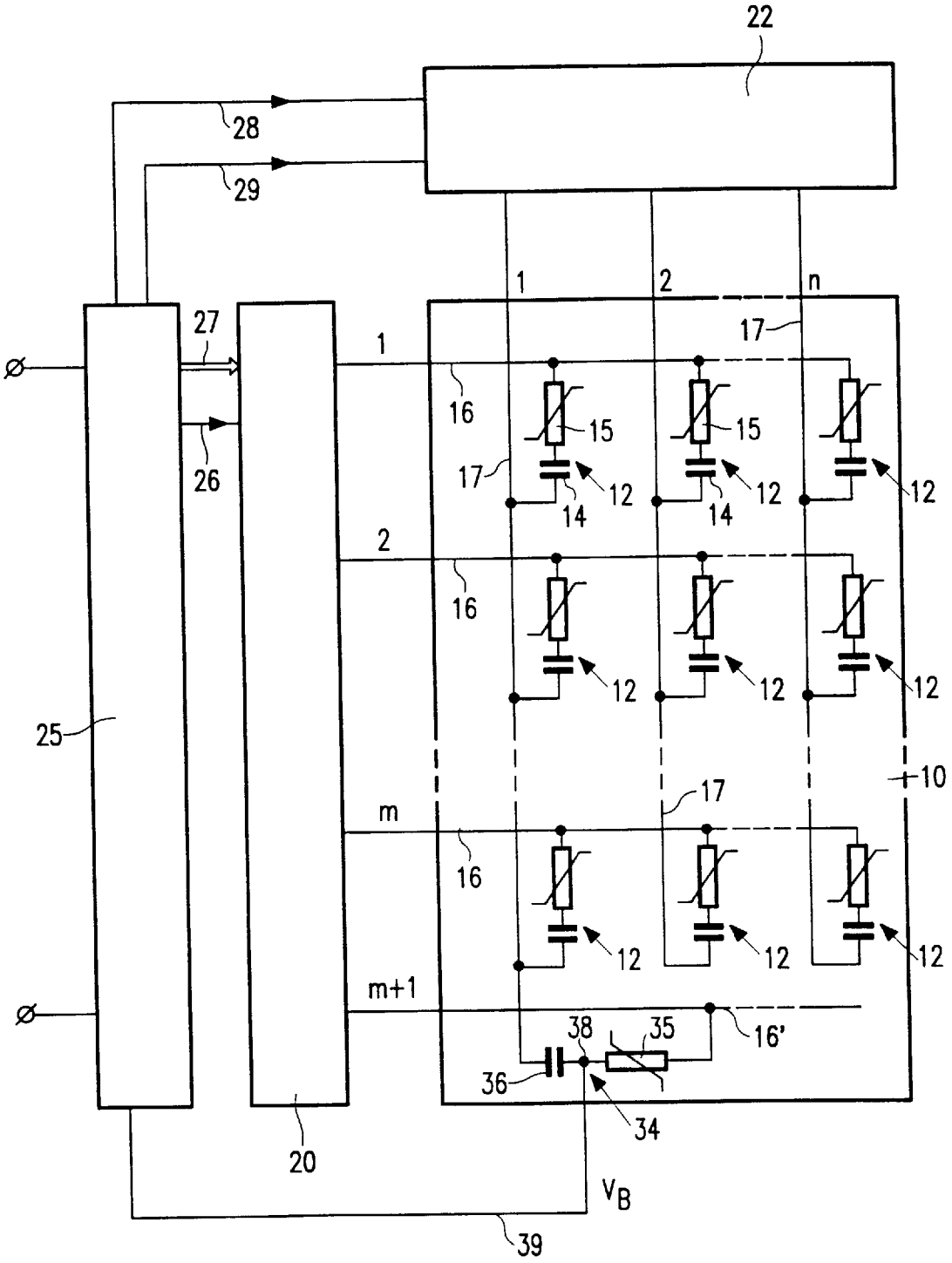
FIG. 1 is a simplified schematic block diagram of an embodiment of display device according to the present invention.

Referring to FIG. 1, the display device, which is intended to display video information such as TV pictures or datagraphics, comprises an active matrix addressed liquid crystal display panel 10 consisting of m rows (1 to m) with n picture elements (1 to n) in each row. Each picture element 12 comprises a twisted nematic liquid crystal display element 14 connected electrically in series with a two-terminal, bidirectional, non-linear resistance switching device 15, exhibiting a threshold characteristic and acting as a switching element, between a row address conductor 16 and a column address conductor 17. The sets of m row and n column address conductors 16 and 17, via which the elements 12 are addressed, are in the form of electrically conductive lines carried on respective opposing faces of two, spaced, glass supporting plates (not shown) also carrying the opposing electrodes of the liquid crystal display elements. The devices 15 are provided on the same plate as the set of row conductors 16.

The row conductors 16 serve as scanning electrodes and are addressed by a row drive circuit 20 which applies to each row conductor a scanning signal waveform comprising selection signals. The selection signals are applied to each row conductor 16 sequentially in turn in successive field periods. In synchronism with the scanning signals, data signals are applied to the column conductors 17 from a column drive circuit 22 to produce the required display from the rows of picture elements associated with the row conductors 16 as they are scanned. Each column conductor is thus provided with a succession of data signals. In the case of a video, e.g. TV, display system these data signals comprise video information. The selection signal component of the row scanning waveform determines a row selection period in which the display elements in a row are driven via their associated switching devices and their optical transmissivities set to produce the required visible display effect according to the level of the data signals present on the conductors 17 during this period. The individual display effects of the display elements 14, addressed one row at a time, combine to build up a complete picture in one field, the picture elements being driven again in the same manner in subsequent fields. Using the transmission/voltage characteristics of a liquid crystal display element grey scale levels can be achieved. The voltage/conduction characteristic of the two-terminal non-linear devices 15 is bidirectional so that by reversing the polarity of the scanning and data signal voltages in, for example, successive fields a net dc bias across the display elements is avoided. Liquid crystal display devices employing two terminal non-linear switching devices in series with the display elements are generally well known and hence the foregoing description of the general aspects and operation of the display device with regard to FIG. 1 has deliberately been kept brief for simplicity.

The row and column driver circuits 20 and 22 are of generally conventional form and their operations are controlled by a timing and control circuit, generally referenced at 25, which comprises a video processing unit, a timing signal generation unit and a power supply unit. The row drive circuit 20 comprises a digital shift circuit and switching circuit to which timing signals and voltages determining the scanning signal waveforms are applied from the circuit 25 through supply lines 26 and 27. The column driver circuit 22 comprises one or more shift register/sample and hold circuits to which video data signals from the video processing unit, and derived from a video (TV) signal containing picture and timing information, are supplied via a line 28. Timing signals are supplied to the circuit 22 along the line 29 in synchronism with row scanning to provide serial to parallel conversion appropriate to the row at a time addressing of the panel 10.

Row scanning is accomplished using a waveform comprising either four or five levels, as described for example in GB-A-2129182 and U.S. Pat. No. 5,159,325 respectively from which further information can be obtained and whose disclosures are incorporated herein by reference.

In this embodiment the non-linear devices 15 comprise amorphous silicon nitride thin film diodes (TFDs), although other forms of non-linear switching devices exhibiting a threshold characteristic, for example diode rings, back to back diodes, or other diode structures, may be used instead.

The display device includes a reference circuit 34 comprising a series combination of a reference non-linear switching device 35 connected electrically in series with a capacitor 36. The device 35 in this embodiment comprises a TFD of the same kind as the devices 15 and is fabricated on a substrate of the panel 10 simultaneously with the devices 15, using the same technology and materials so that its structure is substantially identical to that of the TFDs 15, although it may have larger physical dimensions so as to ensure that stray capacitance associated with the external circuitry remains small compared to the capacitance of the capacitor 36. The reference circuit 34 thus corresponds to the circuit of a typical picture element 12 and can be regarded for convenience as a reference picture element. The side of the TFD 35 remote from the capacitor 36 is connected to a supplementary, $(m+1)^{th}$, row address conductor 16' and the side of the capacitor 36 remote from the device 35 is connected to one of the column address conductors 17 such that the capacitor 36 and the TFD 35 of the reference circuit are connected in series between the row conductor 16' and the column conductor 17. A scanning signal waveform of the same kind as applied to the row conductors 1 to m is supplied by the row driver circuit 20 to the reference circuit via the row conductor 16' whereby a selection signal is applied to the reference circuit via the row conductor 16' after selection of the $m^{th}$ row and before the selection of row 1 in the next field period. The other end of reference circuit 34 is supplied with a reference data voltage signal which is preselected and the equivalent of a column, (data), voltage signal, hereinafter referred to as $V_A$, from the column drive circuit 22 via the column address conductor 17. The reference data signal is supplied to the column conductor 17 immediately after the data signal for the picture element 12 in row m connected to that conductor 17 and before the application of the data signal for the picture element in row 1 in the next field. The reference circuit 34 is thus driven in sequence with the rows of picture elements in successive fields and in a similar manner to the picture elements by periodic application of selection signals causing the capacitor 36 to charge up to a level according to the reference data signal. Any changes which may occur in the operational characteristics of the TFD 35 over a period of time can be regarded as reflecting, and representative of, corresponding changes in the TFDs 15 of the picture elements. Such changes are sensed in the circuit 25 by means of a line 39 connected to the junction 38 between the capacitor 36 and the TFD 35.

The function of the reference circuit 34 is to provide information indicative of changes in the operational behaviour of the TFD 35, and particularly drift in its I–V characteristics, which might occur during operation of the display device over a period of time. This information is utilised in the circuit 25 to adjust the levels of the drive voltages used for driving the picture elements so as to compensate for the effects of such changes and maintain the desired display voltages across the display elements despite changes in the TFD's characteristics due to ageing. Without this compensation the voltage appearing on the display elements for a given data signal value can change over a period of time due to a change in the on-current of the non-linear devices 15. The nature of the changes in the TFD characteristics, the effect of these changes, and the compensation for such changes, as well as the general function of the reference circuit, are described in U.S. Pat. No. 5,428,370 to which reference is invited.

Figure 2:
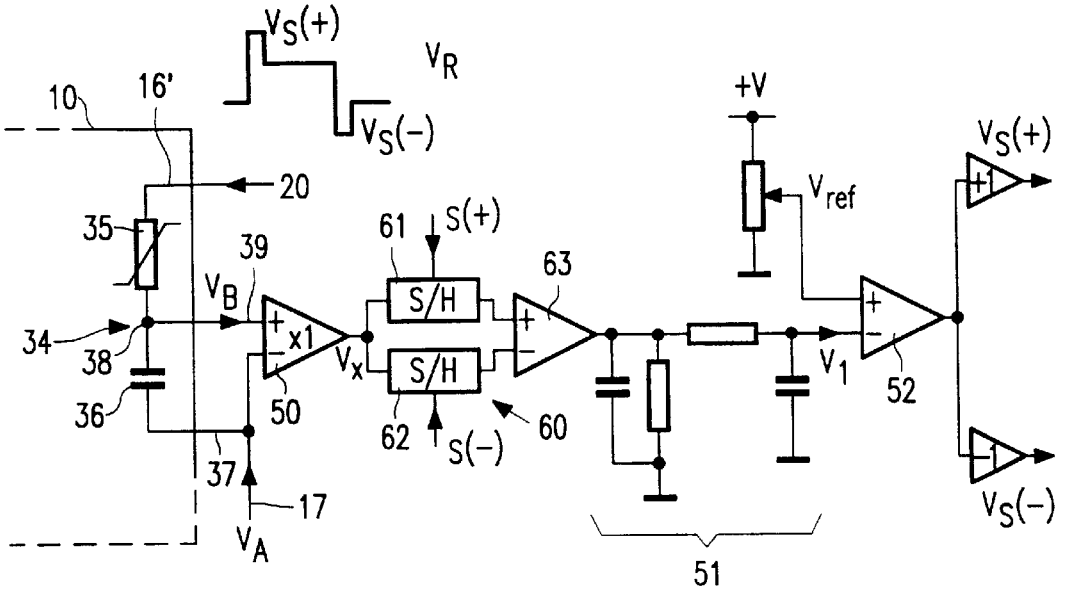
FIGS. 2 and 3 illustrate schematically alternative arrangements for a part of the drive circuit of the display device which includes a reference circuit operable in a feedback circuit for compensating for changes in the characteristics of two-terminal non-linear switching devices of the picture elements for the case in which one kind of known drive waveform is used.
Figure 3:
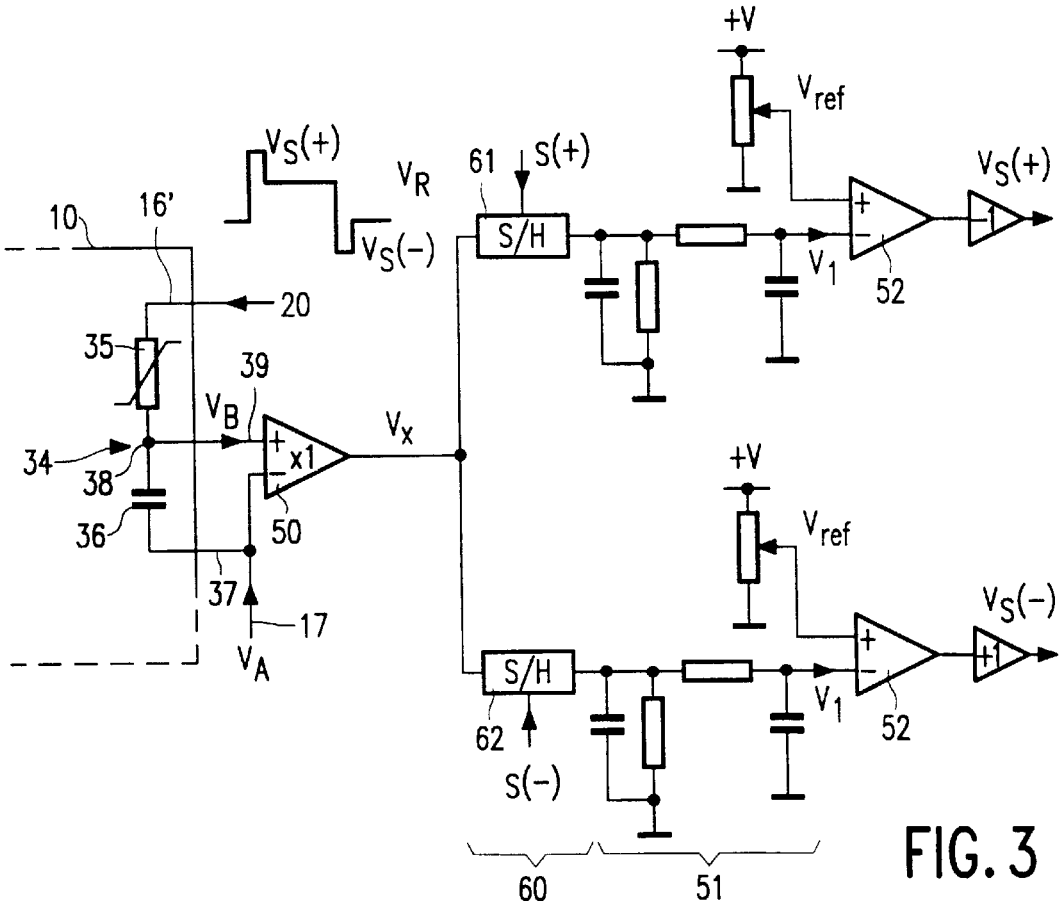

FIGS. 2 and 3 illustrate alternative forms of a circuit arrangement for a part of the drive circuit including the reference circuit 34 and the circuit 25 for adjusting the levels of drive voltages. This is similar to a circuit arrangement described in U.S. Pat. No. 5,428,370, but incorporates modifications according to the present invention. The circuit arrangements of FIGS. 2 and 3 are suitable for the case where a four level row scanning signal waveform, $V_R$, is used, as depicted schematically in the figures. Such a waveform consists of a positive selection signal portion of magnitude $V_S(+)$ whose duration determines a row selection period (i.e. line time) followed by a hold voltage level of like polarity for the remainder of the field period. These levels are inverted in successive fields so that the waveform comprises in alternate field periods a negative, $V_S(-)$, selection signal portion followed by a hold voltage level of like polarity, thus making a four level waveform. The effect of drift caused by ageing in a TFD is to reduce the display element voltage for a given data signal level. By increasing the magnitude of the selection signals $V_S(+)$ and $V_S(-)$ this effect can be compensated and the display element voltages restored to the originally-intended level.

Referring to FIG. 2, the voltage $V_A$ (a reference data signal voltage) supplied from the column drive circuit 22 via the column address conductor 17 to one side of the capacitor 36, is fed also to one input of a subtractor circuit 50 contained in the circuit 25. The voltage existing at the junction 38, designated $V_B$, is fed, via the line 39, to the other input of the subtractor circuit 50. The reference circuit 34 together with the subtractor circuit 50 constitute a drift sensor sensing the voltage across the capacitor with the output from circuit 50 comprising a voltage signal, $V_x$, representing the voltage across the capacitor 36, and thus indicative of changes, particularly drift, in the operational characteristics of the TFD 35. The value of the voltage signal $V_x$ is utilised by an adjustment circuit. In this, the value of $V_x$, representing the voltage across the capacitor 36, ($V_A$-$V_B$), is compared, preferably after passing through a low pass filter 51 to reduce the amount of any noise present, with a predetermined reference voltage $V_{ref}$ in a comparator circuit 52. The output from the comparator circuit 52, representing the difference, is used to control the voltage levels provided by the power supply unit within the circuit 25 to the row driver circuit 20 used for the selection signals $V_S(+)$ and $V_S(-)$, as shown in FIG. 2. A decrease in the value of $V_x$ therefore causes $V_S(+)$ and $V_S(-)$ to be increased until $V_x$ is again equal to $V_{ref}$. The time constant of the feedback loop of this circuit is significantly longer than a field period.

Unlike the circuit arrangement described in U.S. Pat. No. 5,428,370 in which the output $V_x$ from the subtractor circuit 50 is merely supplied to the filter circuit 51 via a rectifier circuit, the circuit arrangement of FIG. 2 includes a sample and hold circuit arrangement 60 comprising two sample and hold circuits 61 and 62. The circuits 61 and 62 are operated respectively by control signals S(+) and S(−) in accordance with the selection signals $V_S(+)$ and $V_S(-)$ applied to the row conductor 16' so as to sample and hold the signal $V_x$ representing the voltage across the capacitor 36 at particular and defined times. These sampled values are then used to determine any necessary adjustment. The sampling occurs immediately after the reference circuit has been addressed with the selection signals $V_S(+)$ and $V_S(-)$ respectively and, bearing in mind that data signals for a column of picture elements 12 in the array are also supplied via the same column conductor 17 used for the reference circuit 34, while the reference data signal is still being applied, and thus before the signal level on that column conductor 17 has changed. Voltage signals $V_x$ for alternate polarity fields are thus sampled and held separately within the circuits 61 and 62 respectively. The contents of the circuits 61 and 62 are supplied to positive and negative inputs respectively of a subtractor circuit 63 whose output, comprising the difference of the stored values, is passed to the low pass filter 51 of the adjustment circuit and used, as before, to effect any necessary adjustment.

In the alternative form of the circuit arrangement shown in FIG. 3, the adjustment circuit part is in effect duplicated to provide separate and independent adjustment of the levels for $V_S(+)$ and $V_S(-)$ with the outputs of the sample and hold circuits 61 and 62 being supplied respectively to the two adjustment circuits where the two selection signal voltages are adjusted independently.

These modified circuit arrangements overcome problems which can occur with the circuit arrangement known from U.S. Pat. No. 5,428,370 due, for example, to part of the signal waveform present on the column conductor 17 used by the reference circuit being capacitively coupled onto the line 39 and affecting the signal $V_x$. In that known circuit arrangement, the voltage $V_B$ on line 39 is continuously monitored and averaged to give a mean DC level which is used in the feedback loop. An alteration of the mean DC level caused by such capacitive coupling effects causes an unwanted interaction in which the adjustment circuit compensates for DC shifts which are not due to changes in the TFD characteristics. By using the sample and hold circuit arrangement 60 so as to utilise, for the purposes of signal level adjustment, the signal $V_x$ representing the voltage across the capacitor 36 at particular and defined times rather than in a continuous manner, such problems are avoided, and considerably improved performance in compensating for the effects of non-linear device ageing is obtained.

Figure 4A:
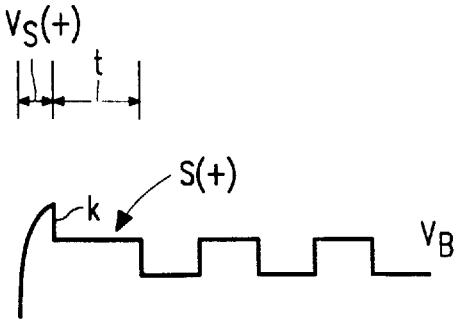
FIGS. 4A and 4B show typical voltage waveforms appearing in the reference circuit during operation.
Figure 4B:
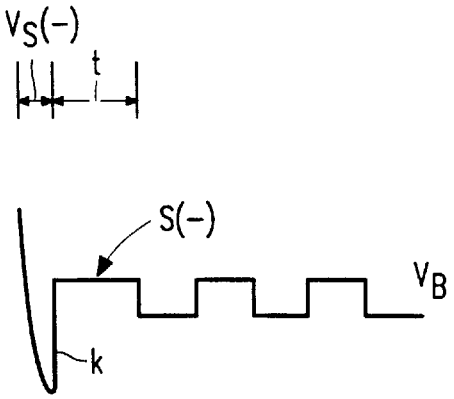
Figure 7A:
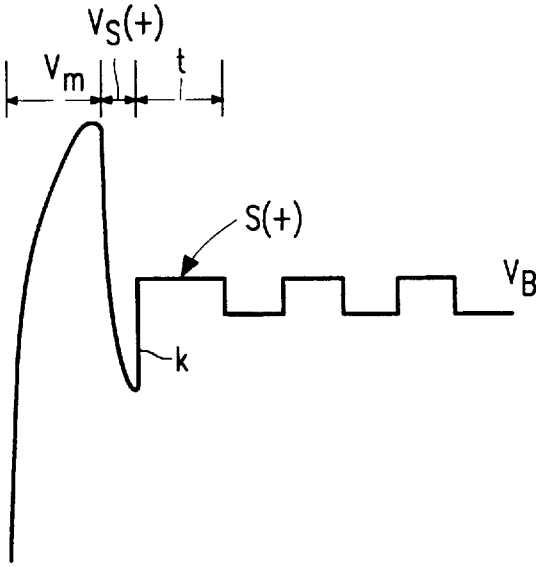
FIGS. 7A and 7B show typical voltage waveforms appearing in the reference circuit during operation with this alternative drive waveform.
Figure 7B:
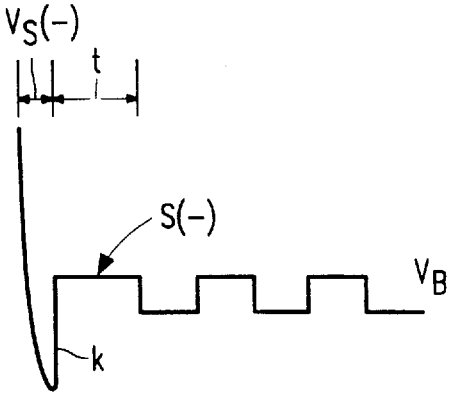

FIGS. 4A and 4B show waveforms illustrating typical voltage levels for $V_B$ obtained on the line 39 during short periods including a positive selection signal $V_S(+)$ and a negative selection signal $V_S(-)$ respectively. As can be seen, upon termination of the selection signal the voltage $V_B$ is affected by capacitive kickback, indicated at k, before reaching a certain level for a short period, t, before the level of the signal on the column conductor 17 changes, i.e. the appearance on the conductor 17 of a data signal for a picture element, at which time the level is changed due to a capacitive coupling effect and then continues to change with each change of data signal applied to the conductor. The sample and hold operation is performed during the period t, the level during this period having been determined by the level of the selection signal and the level of $V_A$ applied to the reference circuit during the selection period.

Figure 5:
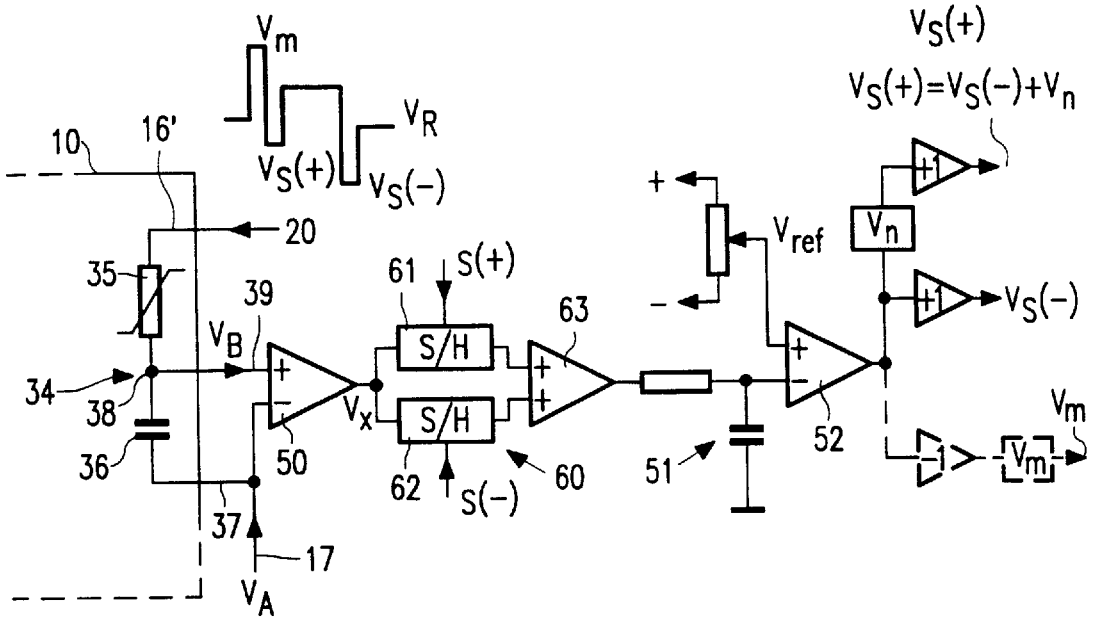
FIGS. 5 and 6 illustrate alternative arrangements for a part of the drive circuit in the case of an alternative known drive waveform being used.
Figure 6:
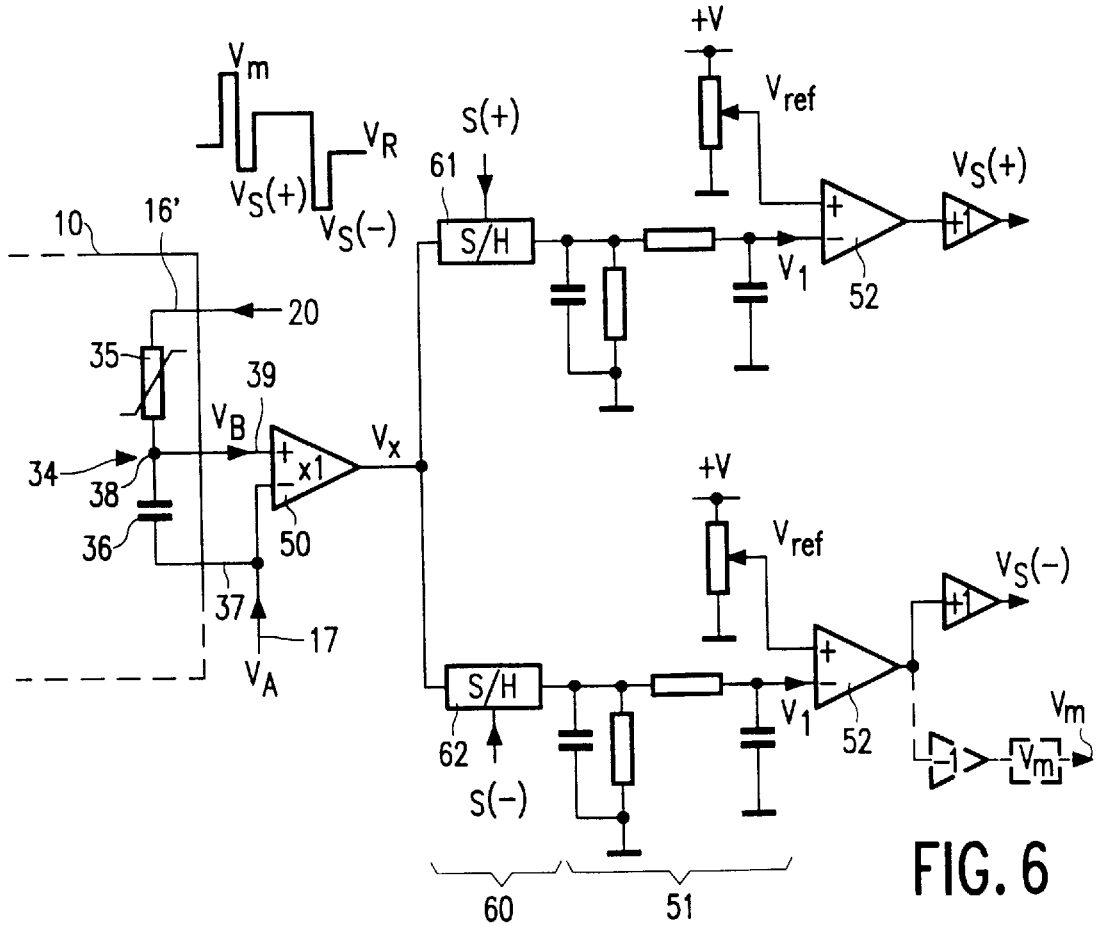

FIGS. 5 and 6 illustrate further, and alternative, embodiments of circuit arrangements for a part of the drive circuit including the reference circuit and adjustment circuit, again similar to circuit arrangements described in U.S. Pat. No. 5,428,370 but with modifications, for use in the case where a five level waveform for the row scanning signal is employed. Briefly, the scanning signal waveform $V_R$, as depicted in FIGS. 5 and 6, comprises in addition to positive and negative selection signals $V_S(+)$ and $V_S(-)$, and the intervening hold signal levels of like polarities, a reset signal $V_M$ which occurs immediately before a positive selection signal and which can be regarded as a further selection signal. The effect of drift in the TFD characteristics due to ageing in a display device using this kind of row scanning signal waveform is to cause a shift in the DC level of the display element voltage, which leads to problems with image storage. By appropriate adjustment of the selection signal voltage levels, and optionally the level of the reset signal as indicated by the dotted lines in the Figures, in the scanning signal waveform the DC level of the display element voltage can be returned to its original value (i.e. substantially zero) thereby compensating for this effect.

Referring to FIGS. 5 and 6, the necessary adjustment to the levels of the scanning signal waveform is accomplished in similar ways to those of FIGS. 2 and 3 respectively apart from certain features of part of the adjustment circuit, as will be appreciated upon comparing the figures. The same reference numbers are used to designate the same, or similar, parts. In the FIG. 5 arrangement, the circuit 63 is used in this case to provide the mean of the sampled values held in the sample and hold circuits 61 and 62 rather than the difference of these values as in the case of the FIG. 2 arrangement. The arrangements of FIGS. 5 and 6 differ, as with FIGS. 2 and 3, in that in the circuit arrangement of FIG. 5 the voltages levels are modified according to the mean of the contents of the sample and hold circuits 61 and 62 whereas in the arrangement of FIG. 6 the contents of the two sample and hold circuits 61 and 62 are used to adjust the levels of the positive and negative selection signals separately and independently.

The level of the voltage signal $V_A$ in all the above-described embodiments is a predetermined value chosen to correspond to an average of the data signals levels applied to the picture elements, either assumed or actual. The polarity of this signal is switched every field. Ways in which the signal $V_A$ can be derived are described in U.S. Pat. No. 5,428,370.

As is also described in that specification, the capacitor 36 may comprise thin film metal layers separated by a dielectric layer on the support of the panel carrying the TFDs, although preferably, it comprises a liquid crystal display element like the display elements 14.

Moreover, more than one reference circuit may be used. For example, and as described in U.S. Pat. No. 5,428,370, the reference circuits can comprise one, or more, rows of pseudo picture elements alongside the array of picture elements but outside the display area and not used for display purposes. The, or each, row of reference circuits is addressed via a common row conductor (16') and the set of column conductors 17 used for the array of picture elements 12, each reference circuit being connected to a respective one of the column conductors. The junctions 38 in each reference circuit are connected together by a further conductor extending in the row direction from which the voltage level $V_B$ is obtained, which conductor is connected to the line 39.

Although a sample and hold circuit arrangement 60 comprising separate sample and hold circuits for operation with respectively positive and negative selection signals is used in the above-described embodiments, it is envisaged that just one sample and hold circuit which samples the capacitor voltage signal upon either the positive or negative selection signals only is employed and this single sampled value is used for the purpose of effecting adjustments.

Thus, in summary, an active matrix display device has been described having an array of picture elements comprising electro-optic, for example LC, display elements and associated switching devices, for example thin film diodes, driven by selection and data signals applied to sets of row and column address conductors respectively, which includes a reference circuit comprising a switching device connected to a capacitive element and similarly driven periodically by selection signals and a reference data signal applied via one of the column address conductors, and an adjustment circuit which senses the voltage at the capacitive element, indicative of the operational behaviour of the switching device at particular times corresponding substantially to the termination of a selection signal applied to the reference circuit and which, according to the sensed voltage at that time is operable to adjust the drive voltages used for the picture elements so as to compensate for changes in operational behaviour of the switching device.

From reading the present disclosure, other modifications will be apparent to persons skilled in the art. Such modifications may involve other features which are already known in the design, manufacture and use of systems already known in the field of active matrix display devices and component parts thereof and which may be used instead of or in addition to features already described herein.

I claim:

1. An active matrix display device comprising a set of row address conductors and a set of column address conductors, an array of picture elements each of which is connected to a respective address conductor of both sets and comprises an electro-optical display element connected to a switching device through which the display element is driven, drive means for applying driving signals to the sets of address conductors for driving the picture elements and comprising selection signals applied to one set of address conductors and data signals to the other set, a reference circuit to which the drive means is arranged to apply periodically selection signals corresponding to those applied to the one set of address conductors and a reference data signal which is applied via one of the address conductors of the other set, the reference circuit comprising a capacitive element and a switching device of the same kind as those of the picture elements connected such that the capacitive element is driven to a voltage according to the reference data signal on the one address conductor of the other set via the switching device upon the application of a selection signal to the reference circuit, and an adjustment circuit for sensing the voltage across the capacitive element of the reference circuit and adjusting the drive signals applied by the drive means to the picture elements in accordance with changes in the sensed voltage across the capacitive element, wherein the adjustment circuit comprises means for deriving a signal indicative of the voltage across the capacitive element sensed substantially upon the termination of the application of a selection signal to the reference circuit, and means for using said indicative signal to adjust the drive signals until the reference circuit is addressed with a subsequent selection signal.

2. An active matrix display device according to claim 1, wherein the means for deriving the signal indicative of the voltage across the capacitive element derives said indicative signal immediately after the termination of the selection signal and before the termination of the reference data signal applied to the reference circuit.

3. An active matrix display device according to claim 1, characterised in that the switching devices comprise two-terminal non-linear switching devices, the switching device of each picture element being connected in series with the display element between respective address conductors of both sets, and the reference circuit comprising a series arrangement of the switching device and the capacitive element to one end of which the selection signals are applied and to the other end of which the reference data signal is applied.

4. An active matrix display device according to claim 3, wherein the adjustment circuit comprises a sample and hold circuit which provides the signal indicative of the voltage across the capacitive element and which samples and holds a voltage signal representing the voltage across the capacitive element in accordance with said selection signals applied to the reference circuit by the drive means.

5. An active matrix display device according to claim 4, wherein the drive means comprises means for providing positive and negative selection signals alternately to the one set of address conductors and the reference circuit and wherein the sample and hold circuit samples and holds said voltage signal separately in response to positive and negative selection signals respectively.

6. An active matrix display device according to claim 5, characterised in that the separate sample voltage signal values are supplied from the sample and hold circuit to an arithmetic combining circuit whose output is used to determine adjustment to the drive signals.

7. An active matrix display device according to claim 6, wherein the adjustment circuit comprises means for adjusting the level of the positive and negative selection signals provided by the drive means.

8. An active matrix display device according to claim 5, wherein the adjustment circuit comprises means for adjusting the positive and negative selection signals independently according to the separate sampled voltage signal values.

9. An active matrix display device according to claim 2, characterised in that the switching devices comprise two-terminal non-linear switching devices, the switching device of each picture element being connected in series with the display element between respective address conductors of both sets, and the reference circuit comprising a series arrangement of the switching device and the capacitive element to one end of which the selection signals are applied and to the other end of which the reference data signal is applied.

* * * * *